US009796111B2

(12) United States Patent
Galletti

(10) Patent No.: US 9,796,111 B2
(45) Date of Patent: Oct. 24, 2017

(54) MIXING BLADE HAVING NEGATIVELY INCLINED FRONT MIXING PLATE

(71) Applicant: OFFICINE MECCANICHE GALLETTI O.M.G. SRL, Perugia (IT)

(72) Inventor: Paolo Galletti, Perugia (IT)

(73) Assignee: OFFICINE MECCANICHE GALLETTI O.M.G. SRL, Perugia (IT)

( * ) Notice: Subject to any disclaimer, the term of this patent is extended or adjusted under 35 U.S.C. 154(b) by 0 days.

(21) Appl. No.: 14/784,875

(22) PCT Filed: Apr. 15, 2014

(86) PCT No.: PCT/IB2014/060738
§ 371 (c)(1),
(2) Date: Oct. 15, 2015

(87) PCT Pub. No.: WO2014/170827
PCT Pub. Date: Oct. 23, 2014

(65) Prior Publication Data

US 2016/0059438 A1 Mar. 3, 2016

(30) Foreign Application Priority Data

Apr. 15, 2013 (IT) ..... PG2013A0015

(51) Int. Cl.
*B01F 7/18* (2006.01)
*B28C 5/16* (2006.01)
(Continued)

(52) U.S. Cl.
CPC ..... *B28C 5/16* (2013.01); *B01F 7/00041* (2013.01); *B01F 7/00275* (2013.01);
(Continued)

(58) Field of Classification Search
CPC .. B01F 7/00041; B01F 7/165; B01F 7/00275; B01F 2215/0422; B01F 7/18; B01F 7/20;
(Continued)

(56) References Cited

U.S. PATENT DOCUMENTS 3,160,399 A 12/1964 Harrison
4,192,615 A * 3/1980 Fortunski ..... B22C 5/0427 366/312
(Continued)

FOREIGN PATENT DOCUMENTS

DE 1 459 297 A1 12/1968
DE 2038481 A1 * 2/1972 ..... A23G 1/125
(Continued)

OTHER PUBLICATIONS

Search Report and Written Opinion for PCT/IB2014/060738, mailed Sep. 12, 2014.

*Primary Examiner* — Charles Cooley
(74) *Attorney, Agent, or Firm* — Marshall, Gerstein & Borun LLP

(57) ABSTRACT

A mixing blade for a mixer for concrete, mortar, powders, dry or semi-dry granulates, mixtures with a cement base or similar or comparable mixtures or mixes comprises a shank which develops along a longitudinal axis and a mixing wall connected inclined to one end of said shank, transverse to the longitudinal axis. The mixing wall comprises, on one side of the longitudinal axis, a first front mixing plate, and on an opposite side, a second front mixing plate angled backward toward the longitudinal axis with respect to the first front mixing plate, by an angle of inclination of the plate.

9 Claims, 3 Drawing Sheets

(51) Int. Cl.
*B01F 7/00* (2006.01)
*B01F 7/16* (2006.01)
*B28C 5/12* (2006.01)

(52) U.S. Cl.
CPC ..... *B01F 7/165* (2013.01); *B01F 7/18* (2013.01); *B28C 5/12* (2013.01); *B01F 2215/0422* (2013.01)

(58) Field of Classification Search
CPC ..... B01F 7/0025; B01F 7/00258; B01F 7/00075; B01F 7/00158; B01F 7/00058; B28C 5/16; B28C 5/12
USPC ..... 366/325.1, 325.92
See application file for complete search history.

(56) References Cited

U.S. PATENT DOCUMENTS 4,229,110 A 10/1980 Lucke
5,899,568 A * 5/1999 Vonnahme ..... B01F 7/00158 366/325.1
D710,397 S * 8/2014 Galletti ..... D15/28
2008/0130406 A1* 6/2008 Rosso ..... B01F 7/001 366/342
2012/0113742 A1* 5/2012 Braker ..... A23G 1/10 366/279
2016/0059438 A1* 3/2016 Galletti ..... B01F 7/00041 366/65

FOREIGN PATENT DOCUMENTS

DE 28 01 460 A1 7/1979
DE 10 2008 033 644 A1 1/2010
DE 102013219061 B3 * 10/2014 ..... B01F 7/00275
EP 1 302 237 A1 4/2003
EP 1 685 933 A2 8/2006
EP 1 815 906 A1 8/2007
EP 2 146 795 A1 1/2010
EP 2 146 796 A1 1/2010

* cited by examiner

MIXING BLADE HAVING NEGATIVELY INCLINED FRONT MIXING PLATE

FIELD OF THE INVENTION

The present invention concerns a mixing blade usable for example in a mixer, in particular with a vertical axis, for concrete, mortar, powders, dry and semi-dry granulates, mixtures with a cement base or similar or comparable mixtures or mixes.

BACKGROUND OF THE INVENTION

For a long time now in the building trade, mixers for concrete, mortar, powders, dry and semi-dry granulates and similar conglomerate materials have been widely used, to prepare large volumes of such conglomerates, preferably intended to be loaded on vehicle-mounted concrete mixers, and subsequently cast. Examples of mixers are described in the European patent applications EP-A-1.685.933, EP-A-2.146.795 and EP-A-2.146.796 in the name of the present Applicant.

Mixers are known with a horizontal axis and with a vertical axis. In particular, traditional vertical axis mixers used comprise a circular mixing tank inside which one or more vertical rotatable arms operate, usually parallel, intended to mix the mixtures loaded into the tank. One example of a single rotatable vertical arm is described for example in document U.S.-A-2008/0130406. In particular, a plurality of plates, disposed radially with respect to the axial development of the support arm, are associated to the single rotatable vertical arm. The plates are suitably shaped to confer on the material a desired degree of mixing. However, this solution is particularly complex to make, and it is justified to use it only with small-size mixers, since the radial disposition of the plates causes great resistance to the rotation of the shaft, which is difficult to sustain for large quantities of material.

A mixer is also known, from DE-A-28.01.460, that comprises a plurality of blades mounted radially with respect to the rotatable vertical arm.

Each of the blades consists of a shank attached radially to the rotatable vertical arm. The shank is provided in its free end with a shaped mixing portion having two mixing walls reciprocally angled with respect to each other and both toward the rear part of the shank.

The shaped mixing portion is made in a single body with the shank, and is very thick so as to guarantee long duration of the blade despite wear phenomena.

This type of blade is particularly complex to make, they are heavy and not able to confer an adequate mixing action. Moreover, this form of embodiment is difficult to apply to mixers of the planetary type as described hereafter.

Solutions are also known in which each of the rotatable vertical arms carries at the lower end a mixing blade that is also disposed vertical and parallel to the axis of rotation of the rotatable vertical arms; in the course of the rotation of the respective arms, the blades are able to interfere effectively with the mixture to be amalgamated, repeatedly mixing and suitably amalgamating the components of the mixture loaded inside the tank. In this context, planetary mixers are known, in which the mixing blades rotate upon themselves and also around a vertical mixing arm, and which can be configured for example as a single, double or triple cross. Turbine mixers are also known, in which the mixing blades rotate only around a central mixing rotor and not on themselves. The mixing blades traditionally used, in particular for planetary and turbine mixers, have a shank intended to be attached to the respective vertical arm, and a mixing wall, inclined by a determinate blade inclination angle with respect to the shank and formed by symmetrical and tapered front mixing plates, on the right and left with respect to the axis of symmetry. In particular, the front mixing plates of the mixing wall define a so-called blade profile that is, over all, tapered toward the shank. In particular, the mixing blades are usually T-shaped, either with an axial symmetry along their main direction of development, so that the right and left front mixing plates of the mixing wall are equal with respect to the axis of symmetry, or with added material (in the front side), for example on the right, to improve the anti-wear material, giving a convex shape to the plane section of the blade.

The sum of the lengths of the tapered front mixing plates, right and left, corresponds to the overall length of the blade profile, while the sum of the height of the mixing wall and the shank represents the overall height of the mixing blade.

It is known that damage to the mixing blades in this type of mixer is usually due to phenomena of a mechanical nature, in particular abrasive and erosive wear, and also corrosive wear mechanisms, not negligible when the blades move in the mixture at speeds of more than 3.4 m/sec.

There is therefore a need to improve existing mixing blades, so as to reduce the effects of wear upon them.

Purpose of the present invention is to obtain a mixing blade that overcomes the disadvantages of the state of the art, in particular limiting the effects of wear.

The Applicant has devised, tested and embodied the present invention to overcome the shortcomings of the state of the art and to obtain these and other purposes and advantages.

SUMMARY OF THE INVENTION

The present invention is set forth and characterized in the independent claims, while the dependent claims describe other characteristics of the present invention or variants to the main inventive idea.

In accordance with the above purpose, a mixing blade is provided for a mixer, in particular with a vertical axis, for concrete, mortar, powders, dry and semi-dry granulates, mixtures with a cement base or similar or comparable mixtures or mixes, which overcomes the limits of the state of the art and eliminates the defects therein. The mixing blade comprises a shank that develops along a longitudinal axis and a mixing wall connected inclined to one end of the shank, disposed transverse to the longitudinal axis.

According to the present invention, on one side of the longitudinal axis the mixing wall has a first front mixing plate, and on an opposite side, a second front mixing plate angled backward toward the longitudinal axis with respect to the first front mixing plate, by a defined angle of inclination of the plate.

This configuration of the mixing blade, thanks to the second front mixing plate, allows to reduce the effects of wear on the blade.

In some forms of embodiment, the mixing wall of the blade is connected to the shank by means of a foot, inclined with respect to the shank. The inclined foot has a planar front surface from which the first front mixing plate and the second front mixing plate protrude on one side and the other. According to some forms of embodiment, the first front mixing plate lies on the same lying plane defined by the planar front surface, while the second front mixing plate is inclined negatively with respect to the lying plane by said angle of inclination of the plate.

The configuration of the inclined foot allows to increase resistance to the mechanical stresses to which the front wall is subjected during use and allows to define a plane for the correct positioning of the first front mixing plate. The positioning of the first front plate with respect to the second front plate guarantees a correct mixing action of the material, generating an adequate mixing action in the latter. The negative inclination of the second plate with respect to the first plate allows to reduce the sliding speed of the material in this area with consequent reduction of wear.

The present invention also concerns a mixer with a vertical axis for concrete, mortar, powders, dry and semi-dry granulates, mixtures with a cement base or similar or comparable mixtures or mixes comprising one or more mixing blades according to forms of embodiment described here.

BRIEF DESCRIPTION OF THE DRAWINGS

These and other characteristics of the present invention will become apparent from the following description of some forms of embodiment, given as a non-restrictive example with reference to the attached drawings wherein.

Figure 1:
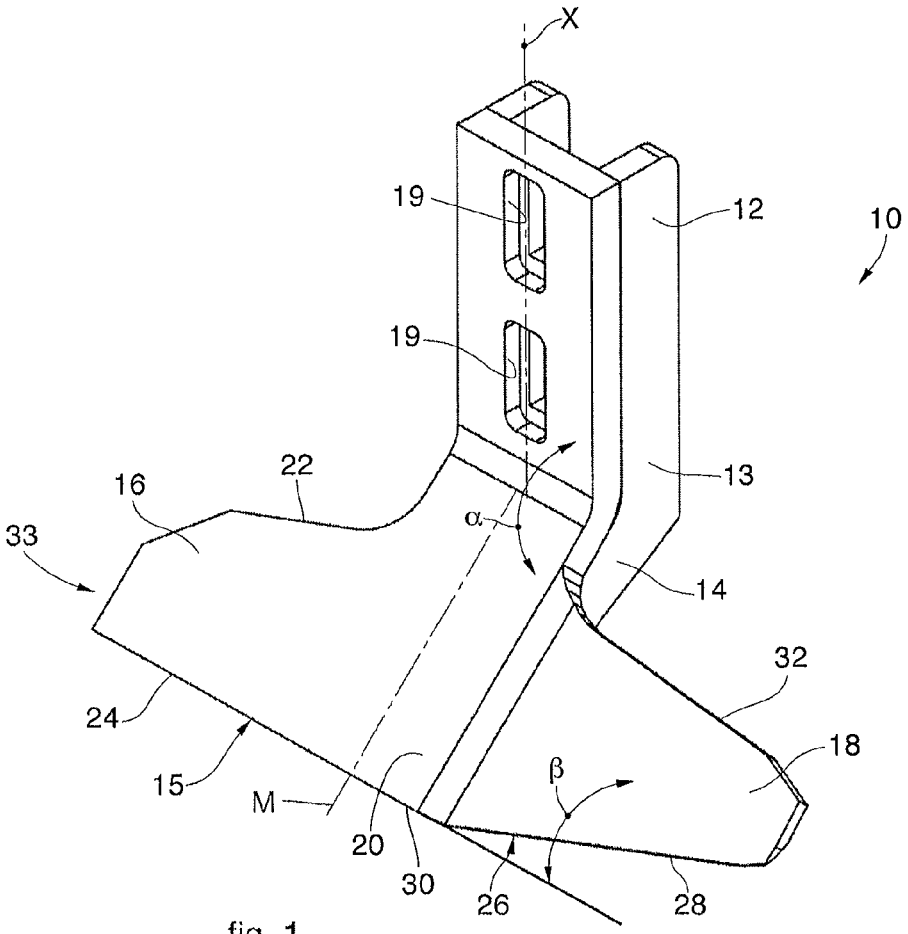
FIG. 1 is a perspective view of a mixing blade according to forms of embodiment described here.

To facilitate comprehension, the same reference numbers have been used, where possible, to identify identical common elements in the drawings. Generally speaking, only the differences in the various forms of embodiment will be described. It is understood that elements and characteristics of one form of embodiment can conveniently be incorporated into other forms of embodiment without further clarifications.

DETAILED DESCRIPTION OF SOME FORMS OF EMBODIMENT

We shall now refer in detail to the various forms of embodiment of the invention, of which one or more examples are shown in the attached drawings. Each example is supplied by way of illustration of the invention and shall not be understood as a limitation thereof. For example, the characteristics shown or described insomuch as they are part of one form of embodiment can be adopted on, or in association with, other forms of embodiment to produce another form of embodiment. It is understood that the present invention shall include all such modifications and variants.

Figure 2:
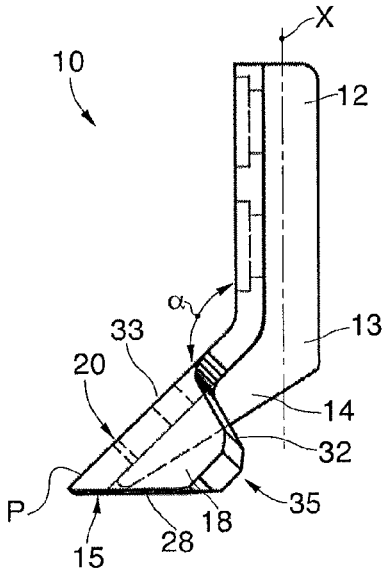
FIG. 2 is a lateral view of a mixing blade according to forms of embodiment described here.
Figure 3:
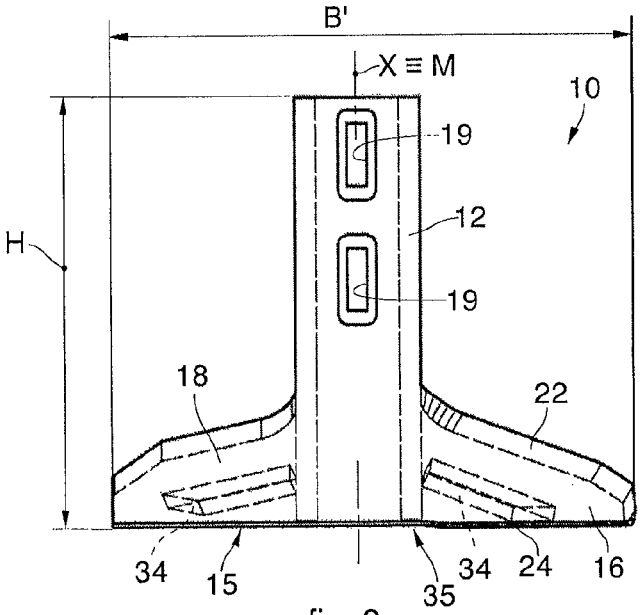
FIG. 3 is a rear view of a mixing blade according to forms of embodiment described here.

FIGS. 1-3 are used to describe a plurality of forms of embodiment of a mixing blade 10 for a mixer, in particular with a vertical axis, for concrete, mortar, powders, dry and semi-dry granulates, mixtures with a cement base or similar or comparable mixtures or mixes.

In particular the mixing blade 10 according to forms of embodiment described here can be applied in planetary mixers with a vertical axis, in which the blade is subjected both to a rotation movement on itself, and also to a revolution movement, or rotation with respect to an external axis, as well as in turbine mixers with a vertical axis in which the mixing blade 10 performs only the revolution movement around the external axis.

The mixing blade 10 comprises a shank 12 and a mixing wall 15. As will be explained more fully hereafter, the shank 12 can be attached to a vertical arm connected to a transverse support provided in the transmission unit of the mixing tank of the mixer in question. To this end, the shank 12 can be provided for example with one or two attachment holes, or eyelets 19, for the insertion of releasable attachment elements.

The shank 12 has a longitudinal axis X along which the mixing blade 10 mainly develops.

In particular, typically the mixing wall 15 develops or is positioned transverse to the longitudinal axis X of the shank 12. Moreover, for example, the mixing wall 15 can have a front surface 33 (see FIG. 1 for example) and a rear surface 35 (see FIG. 3 for example) which during use are subjected, in different ways from each other, to those phenomena of wear that are typically involved in the mixing operations described here. For example, it can be considered that, during the mixing operation, the front surface 33 of the mixing wall 15 is the one most subjected to the phenomena of wear that are typical of the mixers in question. The mixing wall 15 is generally disposed or connected inclined with respect to the shank 12 by an angle of blade inclination $\alpha$. This angle of blade inclination $\alpha$ can be comprised between 120° and 150° for example.

In some example embodiments, an inclined foot 14 can be provided at the lower part, which protrudes for example from a lower end 13 of the shank 12. This inclined foot 14 is angled according to a defined angle of the foot, that defines overall the inclination angle $\alpha$ of the mixing wall 15 with respect to said shank 12.

In some forms of embodiment, the mixing wall 15 comprises a first front mixing plate 16 and a second front mixing plate 18, angled, that is inclined, with respect to the first front mixing plate 16 by a defined angle of inclination of the plate $\beta$. In other words, the second front mixing plate 18 is bent backwards with respect to the normal lying plane of the first front mixing plate 16.

In some forms of embodiment, the configuration with first front mixing plate 16 and the second front mixing plate 18 angled can be adopted for example both in the case where the mixing wall 15 is traditionally bladed, thus having ample front surface 33 and rear surface 35, and also in the case where the mixing wall 15 is thin, also known as a blade with an inclined beater.

In some forms of embodiment, the first front mixing plate 16 and the second front mixing plate 18 both protrude transversely with respect to the shank 12. In example embodiments, the first front mixing plate 16 and the second front mixing plate 18 protrude from one side and the other of the inclined foot 14. In some forms of embodiment, the inclined foot 14 is provided with a planar front surface 20 of the foot. This planar front surface 20 typically defines a lying plane P (see for example FIG. 2). Generally, the first front mixing plate 16 can lie on a lying plane which is essentially coincident with said lying plane P of the planar front surface 20 of the foot. Instead, according to forms of embodiment described here, the second front mixing plate 18 is inclined negatively with respect to said lying plane P by the angle of inclination of the plate β. In other words, it can be said that, considering a reference plane perpendicular to said planar front surface 20 and passing through the center line of the shank 12 and the mixing wall 15, indicated for example in FIGS. 1, 3, 5 and 6 by the letter M, the lying plane of the first front mixing plate 15 is essentially orthogonal to this reference plane, while the lying plane of the second front mixing plate 18 is essentially inclined negatively by a defined angle equal to β+90° with respect to said reference plane. Here and hereafter, by negative inclination we mean an angle rotated downward in a clockwise direction with respect to the reference plane.

In some forms of embodiment, the angle of inclination of the plate β can be selected in such a way as to minimize the peripheral speed of the blade, on the basis of physical parameters of the mixture and geometric parameters of the machine and the blade.

In some forms of embodiment, the angle of inclination of the plate β can be comprised between 5° and 45°. In possible examples, the angle of inclination of the plate β can be comprised between 10° and 40°, or between 15° and 35°, or again between 20° and 30°. In other possible examples, the angle of inclination of the plate β can be comprised between 5° and 20°, or between 10° and 35°, or again between 15° and 40°, or again between 20° and 45°.

In some forms of embodiment, the first front mixing plate 16 can have a tapered shape only at the rear, while at the front it is rectilinear, while the second front mixing plate 18 can have a tapered shape both at the front and the rear.

For example, in some forms of embodiment, the first front mixing plate 16 is provided with a rear tapered profile 22 which connects to the shank 12 and with a rectilinear front mixing side 24. This rectilinear front mixing side 24 extends essentially as far as in correspondence to the center line M of the mixing wall 15.

In some forms of embodiment, the second front mixing plate 18 comprises at least a front mixing profile 26 provided with at least an inclined segment 28 angled backward with respect to said rectilinear front mixing side 24. For example, the inclined segment 28 can be angled with respect to said rectilinear front mixing side 24 by an angle comprised between about 5° and about 45°.

In possible implementations, in the case where the inclined segment 28 does not directly connect to the rectilinear front mixing side 24 in correspondence to the center line M, it also has an intermediate rectilinear connection segment 30 between the inclined segment 28 and the rectilinear front mixing side 24. In substance, this intermediate rectilinear connection segment 30 connects the center line M of the mixing wall 15 to the inclined segment 28.

In some forms of embodiment, the second front mixing plate 18 comprises a rear profile 32 which is also inclined with respect to the rectilinear front mixing side 24. For example, the rear profile 32 can be essentially parallel to a rectilinear segment 22*a* of the rear tapered profile 22, or the rear profile 32 can be inclined with respect to the rear tapered profile 22.

Figure 4:
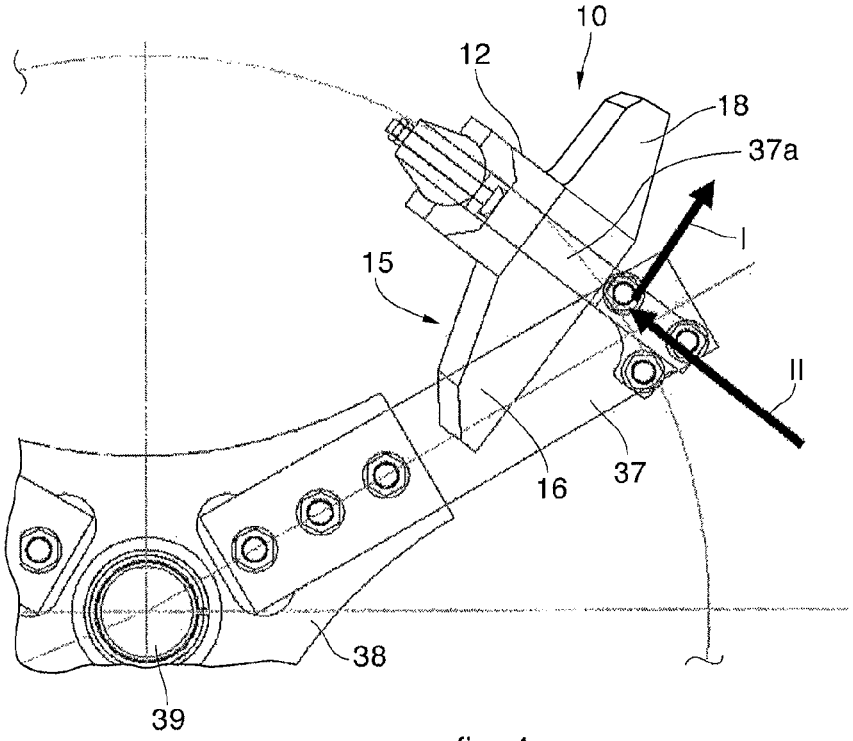
FIG. 4 is a schematic view of a mixing blade according to forms of embodiment described here, assembled on part of a mixer.

FIG. 4 is used to describe examples of forms of embodiment of the mixing blade 10 applied to a mixer, in particular with a vertical axis, for example a planetary or turbine mixer. A mixer with a vertical axis of the type in question provides one or more exit shafts 39 from which radial supports 37 protrude with vertical arms 37A, shaped for example with a change in the inclination, or S-shaped, that is, with two changes in inclination, that support the mixing blades. The latter not only rotate around an exit shaft 39 but can also rotate on themselves (planetary mixer), or can be fixed and rotate only around said exit shaft 39 (turbine mixer). In particular, the mixing blade 10 can be attached to a respective vertical arm 37A with a radial support 37 and connected, for example by means of a central hub 38, with lobes for example, or equivalent rotating connecting component, to a corresponding exit shaft 39.

Figure 5:
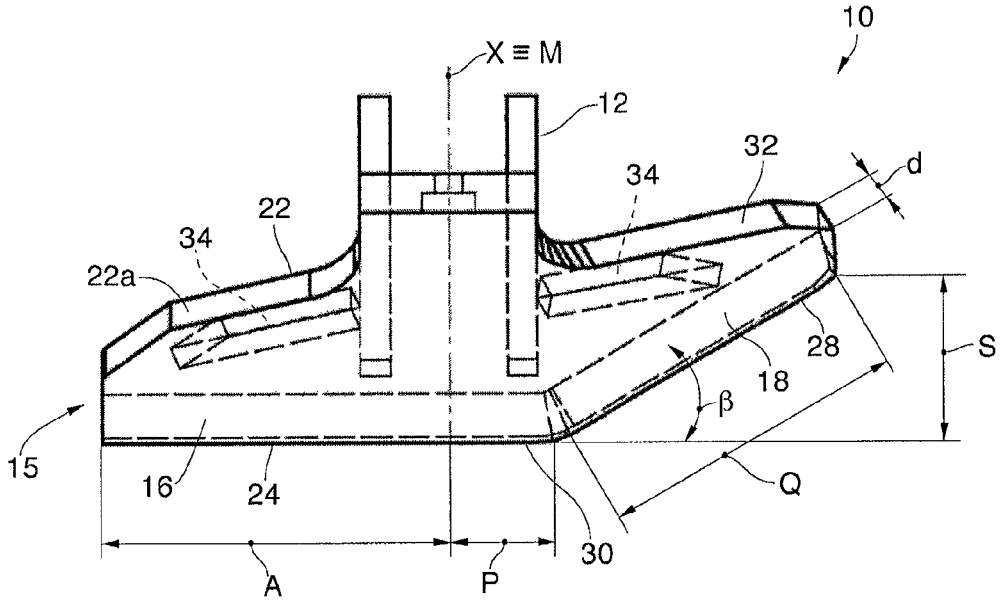
FIG. 5 is a front view of part of a mixing blade according to forms of embodiment described here.

In possible forms of embodiment, described for example with reference to FIG. 5, the mixing wall 15 may include one or more structural reinforcement elements 34, inserted inside it, integrated, drowned or incorporated. For example, the reinforcement elements 34 can be an even number, equally distributed between the first front mixing plate 16 and the second front mixing plate 18. In possible implementations, the structural reinforcement elements 34 can also be provided for example in the rear surface 35 of the mixing wall 15. It is clear that the geometry, the number and the position of the structural reinforcement elements 34 can be varied according to specific needs.

Figure 6:
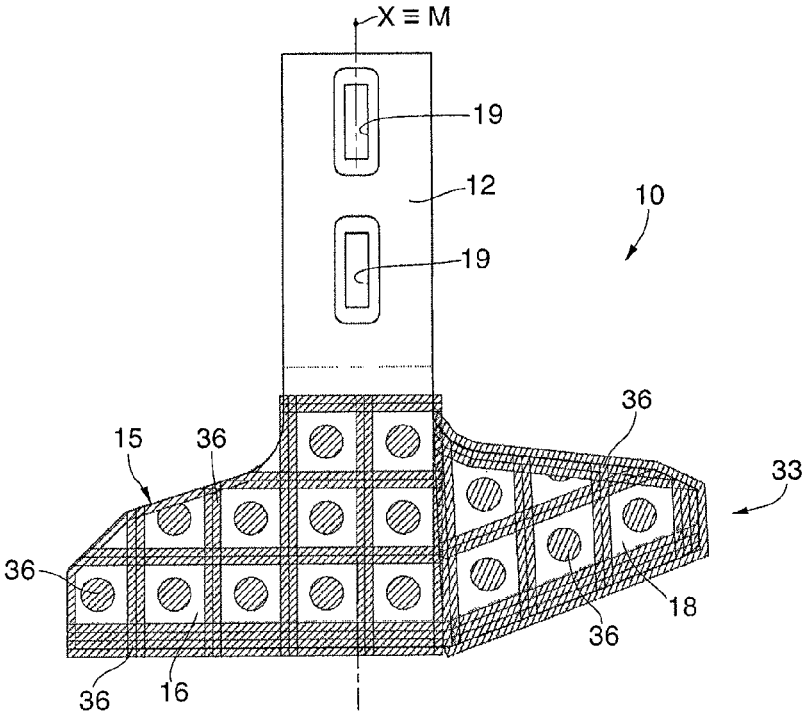
FIG. 6 is a rear view of a mixing blade according to forms of embodiment described here.

In possible forms of embodiment, described for example with reference to FIG. 6, the mixing wall 15 may be completely lined, at the front and/or rear or only partly, using an anti-wear lining material 36, such as for example an anti-wear coating material with resistance to mechanical wear, abrasion or erosion, or to corrosive wear, that is, an anti-wear material applied on the surface of the mixing wall 15. For example, it can be provided in particular that at least the front surface 33 of the mixing wall 15 is lined with said anti-wear lining material 36. The anti-wear lining material 36 can have multiple shapes, design, thickness, depending on the surface and geometry of the mixing wall 15, in particular for example on the surface and geometry of the angled second front mixing plate 18.

In forms of embodiment described using the attached drawings 1-6, the second front mixing plate 18 is shown on the right side with respect to the shank 12 and this solution can be applied in the case of mixers with a clockwise rotation. For machines with an anti-clockwise rotation, the front mixing plate will be angled or bent on the left side.

EXPERIMENTAL DATA

The Applicant has carried out experimental analyses that show how the forms of embodiment of the mixing blade 10 described here are advantageous in reducing the effects of wear.

To this purpose the theoretical mixing model was taken into consideration and the actions that are created during the damp step were examined, given that this is the main source of wear.

In this step, the mixture can be assimilated to a visco-plastic material, also called Bingham fluid, which for minor tangential actions of the sliding limit $\tau_0$ behaves as a rigid body, but for greater values flows like a viscous fluid:

$$\tau=\tau_0+\mu^*\gamma \quad (1)$$

with μ=plastic viscosity and γ=speed gradient.

Evaluating the tangential actions according to formula (1) allows to apply the Reye hypothesis in evaluating the work done by the friction forces, which can be expressed as the work done by the tangential actions that the mixture exerts on the blade. The tangential actions, which are a function of the speed gradient, are influenced by the shape of the blade and in particular by its possible inclination β, hence perpendicular to the plane that defines the blade front.

The tangential actions have a direct proportionality with the viscous force that the blade encounters during motion.

The viscous force and the friction force generate on the mixing members a resistant torque equal to the power absorbed during the damp step.

We can therefore write:

$$F_f=-(\tau_f d)L \quad F_v=-S\,L\mu^{*}nv \tag{2}$$

Where:

$F_f$ is the friction force and $F_v$ is the viscous force;

L is the characteristic size of the blade, that is, the overall length of the mixing plate. This value can correspond to length A indicated in FIG. 5 of the non-inclined front mixing plate, that is, of the rectilinear front mixing side 24, and also to the length Q of the inclined second front mixing plate 18, in particular of the inclined segment 28 (FIG. 5);

$\tau_f$ is the tangential friction action that is created by the "contact" between blade and front of the mixture;

d is the thickness of the blade;

S is the viscous coefficient;

n is the perpendicular to the surface of the blade and v is the blade speed vector. With reference to FIG. 4, the symbols I and II identify the components in the preferential direction of action of the force acting on the front of the blade, where component I is the friction force acting tangentially and component II is the viscous force acting perpendicularly.

It is clear from the above that the phenomenon of wear on the blades mainly affects the outermost zone of the blade, that is, the zone where it moves at its highest speeds. Consequently, by intervening on the shape of the blade, in particular by selecting on each occasion the desired angle of inclination of the plate β to obtain the mathematical minimum of the peripheral speed of the blade based on the physical parameters of the mixture and the geometric parameters of the machine and the blade, using formula (2), the value of the viscous force and the corresponding tangential actions also decrease. This means a reduced impact of the wear action along the surface of the blade and hence an increase in resistance to wear.

The new shape of the mixing blade 10, where the second front mixing plate 18 is angled with respect to the lying plane of the first front mixing plate 16, has therefore been developed by Applicant taking into account the development of the tangential actions as described above. In substance, the mixing blade 10 according to the present invention maintains the same shank as the traditional blade, and also the shape of one of the two front mixing plates, right or left, while the other front mixing plate is inclined or bent backward by an angle β. The value of the angle of inclination β can depend on the type of machine and on the characteristics of the mixture to be mixed.

Examples of the angle β are: 5°, 7°, 10°, 12°, 15°, 18°, 20°, 22°, 25°, 27°, 30°, 32°, 35°, 38°, 40°.

The new shape of the mixing blade 10 can be obtained as a function of the type of mixtures, for example in particular for special mixtures, and the mixers on which it is applied. In particular, the surface and geometry of the inclined second front mixing plate 18 can be personalized according to the type of mixture and machine. Optimization can be achieved using formula (2), where the calculation parameters are based on the characteristics of the mixture and the geometry of the mixing machine. Apart from the parameters of thickness d and characteristic lengths A, Q, and possibly the length P of the connecting segment 30 between the center line M of the blade and the inclined part, other parameters are also taken into consideration, such as overall height of the blade H, overall length of the blade profile in front projection B' (FIG. 3), and the plane projection distance S between the inclined end of the blade and the front straight profile, or rectilinear front mixing side 24, with length L (FIG. 5).

Figure 7:
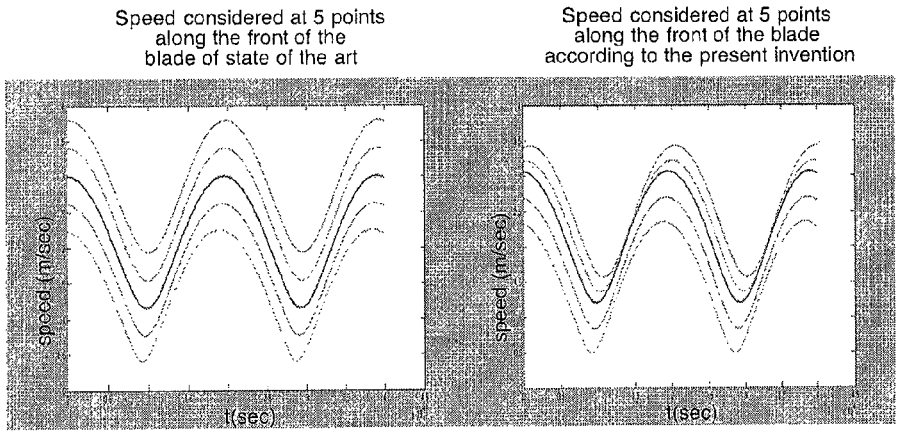
FIG. 7 shows a comparison between two graphs of speed considered at five points along the front of the blade for a traditional blade (on the left) and a blade according to forms of embodiment described here (on the right), in which the y axis shows the speed in m/sec and the x axis shows the time in sec×104.

On the basis of the above, a subsequent kinematic analysis was carried out, which compared the speed of a traditional blade, taken at some points (for example five) of the profile, with the speed of the mixing blade 10 according to the present invention taken at the same points (FIG. 7).

If we compare the two graphs in FIG. 7, it is clear that the mixing blade 10 according to the present invention allows to reduce the speed in the zone most subject to wear, that is, a reduction of up to 30% of the tangential actions on the profile of the blade. Moreover, there is a reduction in the discharge times on the peripheral part of the mixer that can be 20% less per cycle compared with the standard discharge time. Furthermore, in the course of the experimental analysis we also found a reduction in the peak duration of maximum absorption in amps of the electric mixing motors in the most critical step of mixing (hydration of the cement).

As we said, in the case where the mixing blade 10 is applied to mixers with a clockwise rotation, the inclined second front mixing plate 18 is the one provided on the right side, as described for example with reference to FIGS. 1-6. It is clear, however, that when the mixers have an anti-clockwise rotation, the inclined second front mixing plate 18 will be the one on the left side, although all the considerations expressed above remain valid.

It is clear that modifications and/or additions of parts may be made to the mixing blade 10 as described heretofore, without departing from the field and scope of the present invention.

It is also clear that, although the present invention has been described with reference to some specific examples, a person of skill in the art shall certainly be able to achieve many other equivalent forms of mixing blade 10, having the characteristics as set forth in the claims and hence all coming within the field of protection defined thereby.

The invention claimed is:

1. Mixing blade for a mixer for concrete, mortar, powders, dry and semi-dry granulates, mixtures with a cement base or similar or comparable mixtures or mixes comprising a shank which develops along a longitudinal axis and a mixing wall connected inclined to one end of said shank, transverse to said longitudinal axis, wherein the mixing wall comprises, on one side of the longitudinal axis, a first front mixing plate, and on an opposite side, a second front mixing plate angled backward toward the longitudinal axis with respect to the first front mixing plate, by an angle of inclination of the plate, in that said mixing wall is connected to the shank by an inclined foot inclined with respect to the shank, said inclined foot having a planar front surface from which the first front mixing plate and the second front mixing plate protrude on one side and the other, and in that the first front mixing plate lies on the same lying plane defined by the planar front surface, while the second front mixing plate is inclined negatively with respect to the lying plane by said angle of inclination of the plate.

2. Mixing blade as in claim 1, wherein the angle of inclination of the plate is comprised between 5° and 45°.

3. Mixing blade as in claim 1, wherein that the mixing wall comprises one or more structural reinforcement elements.

4. Mixing blade as in claim 1, wherein the mixing wall is completely covered at the front and/or at the rear or only partly, using an anti-wear covering material.

5. Mixer for concrete, mortar, powders, dry and semi-dry granulates, mixtures with a cement base or similar or comparable mixtures or mixes, comprising one or more mixing blades as in claim 1.

6. Mixing blade for a mixer for concrete, mortar, powders, dry and semi-dry granulates, mixtures with a cement base or similar or comparable mixtures or mixes comprising a shank which develops along a longitudinal axis and a mixing wall connected inclined to one end of said shank, transverse to said longitudinal axis, wherein the mixing wall comprises, on one side of the longitudinal axis, a first front mixing plate, and on an opposite side, a second front mixing plate angled backward toward the longitudinal axis with respect to the first front mixing plate, by an angle of inclination of the plate, in that said mixing wall is connected to the shank by an inclined foot inclined with respect to the shank, said inclined foot having a planar front surface from which the first front mixing plate and the second front mixing plate protrude on one side and the other, and in that the first front mixing plate lies on the same lying plane defined by the planar front surface, while the second front mixing plate is inclined negatively with respect to the lying plane by said angle of inclination of the plate, and wherein the first front mixing plate is provided with a tapered rear profile which connects to the shank and with a rectilinear front mixing side, wherein the second front mixing plate comprises at least a front mixing profile provided with at least an inclined segment angled backward with respect to said rectilinear front mixing side.

7. Mixing blade as in claim 6, wherein the inclined segment is angled with respect to said rectilinear front mixing side by an angle comprised between about 5° and about 45°.

8. Mixing blade as in claim 6, wherein the rectilinear front mixing side extends essentially as far as in correspondence with the center line of the mixing wall, wherein the inclined segment connects directly to said rectilinear front mixing side in correspondence to the center line, or the front mixing profile provides an intermediate rectilinear connection segment between the inclined segment and the rectilinear front mixing side.

9. Mixing blade as in claim 6, wherein the second front mixing plate comprises a rear profile inclined with respect to said rectilinear front mixing side.

* * * * *